US007477020B2

(12) United States Patent
Chou

(10) Patent No.: US 7,477,020 B2
(45) Date of Patent: Jan. 13, 2009

(54) ELECTRONIC BALLAST HAVING A REDUCED REVERSE VOLTAGE AT THE START

(75) Inventor: Ching-Ho Chou, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 31 days.

(21) Appl. No.: 11/165,084

(22) Filed: Jun. 23, 2005

(65) Prior Publication Data

US 2006/0022608 A1 Feb. 2, 2006

(30) Foreign Application Priority Data

Jul. 28, 2004 (TW) ..... 93122622 A

(51) Int. Cl.
*H05B 37/02* (2006.01)

(52) U.S. Cl. ..... 315/209 R; 315/224; 315/291; 315/320; 315/324

(58) Field of Classification Search ..... 315/46, 315/209 R, 210, 211, 212, 224, 225, 226, 315/228, 244, 291, 312, 313, 320, 324
See application file for complete search history.

(56) References Cited

U.S. PATENT DOCUMENTS 4,388,562 A * 6/1983 Josephson ..... 315/205
4,572,988 A * 2/1986 Handler et al. ..... 315/209 R
4,700,113 A * 10/1987 Stupp et al. ..... 315/224
5,391,966 A * 2/1995 Garrison ..... 315/308
5,471,118 A * 11/1995 Nilssen ..... 315/247
5,500,792 A * 3/1996 Jeon et al. ..... 363/98
5,751,120 A * 5/1998 Zeitler et al. ..... 315/307
5,880,564 A * 3/1999 Franck ..... 315/247
6,819,057 B2 * 11/2004 Alexandrov ..... 315/209 R
2004/0257004 A1 * 12/2004 Deurloo et al. ..... 315/291

* cited by examiner

*Primary Examiner*—David Hung Vu
*Assistant Examiner*—Tung X. Le

(57) ABSTRACT

An electronic ballast includes an inductor, an output transformer, at least two switching elements, a control circuit, a clamping circuit, and at least two return circuits. The inductor is electrically coupled to a DC power supply. The control circuit is electrically connected to the inductor, the output transformer and the switching elements for controlling on/off statuses of the switching elements. The clamping circuit is electrically connected to the inductor, and limits a node voltage among the inductor, the control circuit, and the clamping circuit below a threshold value and generates an output current on condition that the node voltage is larger than the threshold value. Each of the return circuits is electrically connected to the clamping circuit and coupled to both terminals of one of the switching elements for transmitting the output current to the output transformer, thereby permitting a reverse voltage of the switching elements within a maximum allowable range of the switching elements.

11 Claims, 7 Drawing Sheets

ELECTRONIC BALLAST HAVING A REDUCED REVERSE VOLTAGE AT THE START

FIELD OF THE INVENTION

The present invention relates to an electronic ballast, and more particularly to an electronic ballast having a reduced reverse voltage at the transient moment of start.

BACKGROUND OF THE INVENTION

Generally, the luminous efficacy of a fluorescent lamp is about 80 luminance/watt, which is approximately five times of the conventional incandescent lamp (e.g. 16 luminance/watt). The average life of the fluorescent lamp is about 6,000 hours, which is approximately three times of the conventional incandescent lamp (e.g. 2,000 hours). In addition, heat generated from the incandescent lamp is about 61% of the input power. In contrast, heat generated from the fluorescent lamp is about 37% of the input power, which is much less than that of the incandescent lamp. Since the fluorescent lamp has many advantages over the incandescent lamp, the fluorescent lamp is widely used in offices or homes.

As known, in a case that the lamp tube of the fluorescent lamp is driven to illuminate at a high frequency, a higher light output ratio is achieved when identical output power is applied. In other words, such illuminating approach is less power consuming. With increasing development of electrical and electronic technologies, electronic ballasts are widely employed to replace the starters of the fluorescent lamp system and the conventional ballasts.

Referring to FIG. 1(*a*), a schematic circuit diagram of a conventional electronic ballast is shown. The electronic ballast 10 is not preheated but uses a push-pull parallel resonant circuit. The electronic ballast 10 is powered by a DC power supply 11 and comprises a push-pull parallel resonant circuit 14 including an output transformer 12, a fluorescent lamp 13 and two switching elements Q1 and Q2. By controlling the turning on/off statuses of the switching elements Q1 and Q2, the DC voltage provided by the DC power supply 11 is converted into a high-frequency AC voltage so as to activate several sets of fluorescent lamps 13. The winding T1 is used to monitor a current change in the primary winding of the output transformer 12 so as to control the operation of the switching elements Q1 and Q2, where the winding T1 is a part of the output transformer 12.

The electronic ballast 10 of FIG. 1(*a*) is popular because of some advantages. For example, the mechanism for driving the circuit is simple. In addition, the lamp tubes can be used in parallel. Since both output ends of the electronic ballast can be operated in an open or close circuit mode, no additional protection circuit is required. The lamp tube may be lighted without restarting the electronic ballast when the lamp tube is exchanged. Afterward, the mechanism for starting the electronic ballast is diverse and includes for example rapid start, instant start and program start. On the other hand, the electronic ballast 10 still has some drawbacks. For example, the switching elements Q1 and Q2 have large voltage stresses, the production process of the output transformer 12 is complicated, the volume of the inductor T2 is bulky, and so on. In views of the large voltage stresses of the switching elements Q1 and Q2, the node voltage V1 between the inductor T2 and the parallel resonant circuit 14 will has large transient voltage induced by the parallel resonant circuit 14 at the instant moment when the electronic ballast 10 is started. The transient voltage is slowly reduced and then reaches a steady state. Since the collector-to-emitter voltage (VCE) for the switching element Q1 or Q2 and the node voltage V1 is in a linear relationship. If the node voltage V1 is very large, the switching elements Q1 or Q2 is subjected to a large voltage at the instant moment when the electronic ballast 10 is started, as shown in FIG. 1(*b*).

Accordingly, if the switching element Q1 or Q2 is not conducted, the region between the collector and the emitter thereof should sustain a large output voltage. Otherwise, the switching element Q1 or Q2 may have a breakdown, and thus the electronic ballast 10 fails to normally function. For example, when the electronic ballast 10 is started, the switching element Q1 is conducted but the switching element Q2 is shut, the region between the collector and the emitter of the switching element Q2 should sustain a large transient voltage generated from the node voltage V1. In contrast, when the switching element Q2 is conducted but the switching element Q1 is shut, the region between the collector and the emitter of the switching element Q1 should sustain a large transient voltage generated from the node voltage V1. Generally, the switching element Q1 or Q2 used in the electronic ballast 10 is a transistor capable of sustaining a high voltage such as 1.6 KV (according to the specification of Bipolar Junction Transistor, the sustainable largest transient voltage of VCE is 1 KV or 1.6 KV). However, these transistors are low in selectivity and not cost-effective.

In order to have the region between the collector and the emitter of the transistor sustain a large transient voltage, another conventional electronic ballast is developed, as can be seen in FIG. 2(*a*). The electronic ballast 20 of FIG. 2(*a*) uses a clamping circuit 22 for limiting the node voltage V2 between the inductor T2 and the parallel resonant circuit 24 at the moment when the electronic ballast 20 is started. The node voltage V2 has large transient voltage induced by the parallel resonant circuit 24 at the instant moment when the electronic ballast 20 is started. In such manner, the collector-to-emitter voltage (VCE) for the switching element Q1 or Q2 is reduced, and thus the damage probability of the switching element Q1 or Q2 is reduced. For example, if the node voltage V2 is 1.6 KV at the moment when the electronic ballast 20 is started, the clamping circuit 22 connected to the inductor T2 will limit the node voltage V2 from 1.6 KV down to about 1 KV, wherein the clamping circuit 22 can be a transient voltage suppressor such as Type P6KE400A available from ST Microelectronics or Type P6KE400A available from VISHAY. Accordingly, the transistor to be used in the electronic ballast 20 may have a lower rated voltage, for example 1.0 KV or less, wherein the transistor can be a transistor Type BUL1102E available from ST Microelectronics or Type BUJ403A available from Philips. As known, this transistor has higher selectivity and is cost-effective. In addition, the switching speed of this transistor is very fast and the switching loss thereof is small.

Since the clamping circuit 22 limits the node voltage V2 at the moment when the electronic ballast 20 is started, the reduced voltage is converted into the current Iz, as shown in FIG. 2(*b*). In a case that the switching element Q1 is shut but the switching element Q2 is conducted, the current Iz may flow through the emitter E and the collector C of the switching element Q2. At the moment when the switching element Q2 is conducted, the current generated from the clamping circuit 22 is very large, and thus the reverse voltage between the base B and the emitter E of the switching element Q2 may exceed the maximum allowable range. Under this circumstance, the switching element Q2 may be damaged or the average life thereof may be decreased, and the performance of the electronic ballast 20 is impaired.

FIG. 2(*b*) is a timing waveform diagram illustrating the current Iz from the clamping circuit, the emitter-to-base voltage (VEB) and the collector-to-emitter voltage (VCE) of the switching element Q1 or Q2. An example of the switching elements Q1 or Q2 is a BUL1102E transistor commercial available from ST Microelectronics. The maximum reverse voltage between the base B and the emitter E of the switching element Q1 or Q2 is 12V, i.e. the maximum allowable range of VEB is 12V. The maximum reverse voltage between the collector C and the emitter E of the switching element Q1 or Q2 is 1.1 KV, i.e. the maximum allowable range of VCE is 1.1 KV. As shown in FIG. 2(*b*), when the electronic ballast 20 is started, the transient response of the collector-to-emitter voltage (VCE) of the switching element Q1 or Q2 is limited below 1.1 KV, and the clamping circuit 22 outputs the current Iz. Since the current Iz is very large at the instant moment when the electronic ballast 10 is started, the reverse voltage between the base B and the emitter E of the switching element Q1 or Q2 exceeds 12V. Accordingly, the switching element Q1 or Q2 is readily damaged and the average life thereof will be shortened.

Accordingly, the above-described prior art electronic ballasts are not perfect designs and have still many disadvantages to be solved. In views of the above-described disadvantages resulted from the conventional electronic ballasts, the applicant keeps on carving unflaggingly to develop an electronic ballast according to the present invention through wholehearted experience and research.

SUMMARY OF THE INVENTION

It is an object of the present invention to provide an electronic ballast having a reduced reverse voltage at the transient moment of start.

In accordance with a first aspect of the present invention, there is provided an electronic ballast. The electronic ballast comprises an inductor, an output transformer, at least two switching elements, a control circuit, a clamping circuit, and at least two return circuits. The inductor is electrically coupled to a DC power supply. The control circuit is electrically connected to the inductor, the output transformer and the switching elements for controlling on/off statuses of the switching elements. The clamping circuit is electrically connected to the inductor, and limits a node voltage among the inductor, the control circuit and the clamping circuit below a threshold value and generates an output current on condition that the node voltage is larger than the threshold value. Each of the return circuits is electrically connected to the clamping circuit and coupled to both terminals of one of the switching elements for transmitting the output current to the output transformer, thereby permitting a reverse voltage of the switching elements within a maximum allowable range of the switching elements.

In an embodiment, the output transformer is a centre-tapped transformer.

In an embodiment, the clamping circuit is a transient voltage suppressor for limiting the node voltage below the threshold value and generating the output current on condition that the node voltage is larger than the threshold value.

Preferably, the transient voltage suppressor is a Zener diode.

In an embodiment, each of the switching elements is a NPN-type bipolar junction transistor having a base, a collector and an emitter.

In an embodiment, each of the two return circuits is coupled to the collector and the emitter of one of the switching elements.

Preferably, the return circuits are diodes.

In an embodiment, the control circuit comprises two resistors, a winding of the output transformer and a resonant capacitor.

In an embodiment, the electronic ballast further comprises a plurality of ballast capacitors electrically connected between a secondary winding of the output transformer and at least two lamps.

In an embodiment, the electronic ballast further comprises a preheat circuit electrically connected to the ballast capacitors and the lamps for preheating the lamps.

In an embodiment, the electronic ballast further comprises at least two capacitors, each of which is electrically connected to one of the return circuits and a collector terminal and an emitter terminal of one of the switch elements.

In accordance with a second aspect of the present invention, there is provided an electronic ballast for energizing at least two lamps. The electronic ballast comprises an inductor, at least two switching elements, a clamping circuit, and at least two return circuits. The inductor is electrically connected to a power supply. The clamping circuit is electrically connected to the inductor, and limits a node voltage across both terminals thereof below a threshold value and generates an output current on condition that the node voltage is larger than the threshold value. Each of the return circuits is electrically connected to the clamping circuit and coupled to both terminals of one of the switching elements for providing a path of transmitting the output current, thereby permitting a reverse voltage of the switching elements within a maximum allowable range of the switching elements.

The above contents of the present invention will become more readily apparent to those ordinarily skilled in the art after reviewing the following detailed description and accompanying drawings, in which:

BRIEF DESCRIPTION OF THE DRAWINGS

FIG. 1(*b*) is a timing waveform diagram illustrating the collector-to-emitter voltage (VCE) of the switching element Q1 or Q2 of FIG. 1(*a*);

FIG. 2(*b*) is a timing waveform diagram illustrating the current Iz from the clamping circuit, the emitter-to-base voltage (VEB) and the collector-to-emitter voltage (VCE) of the switching element Q1 or Q2 of FIG. 2(*a*);

FIG. 3(*b*) is a timing waveform diagram illustrating the current Iz from the clamping circuit, the emitter-to-base voltage (VEB) and the collector-to-emitter voltage (VCE) of the switching element Q1 or Q2 of FIG. 3(*a*)

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1A:
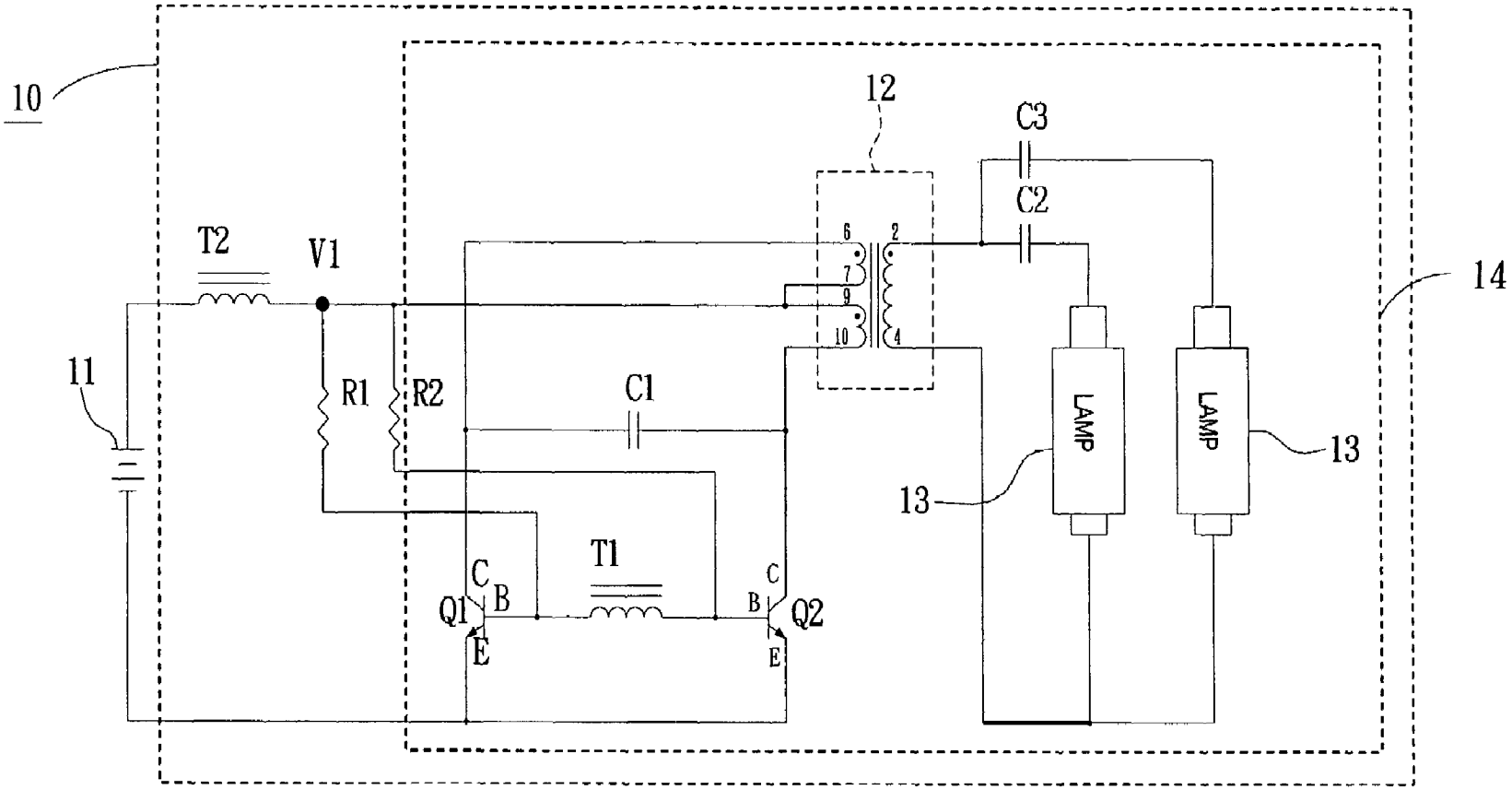
Fig. 1(a) PRIOR ART
FIG. 1(*a*) is a schematic circuit diagram of a conventional electronic ballast.
Figure 1B:
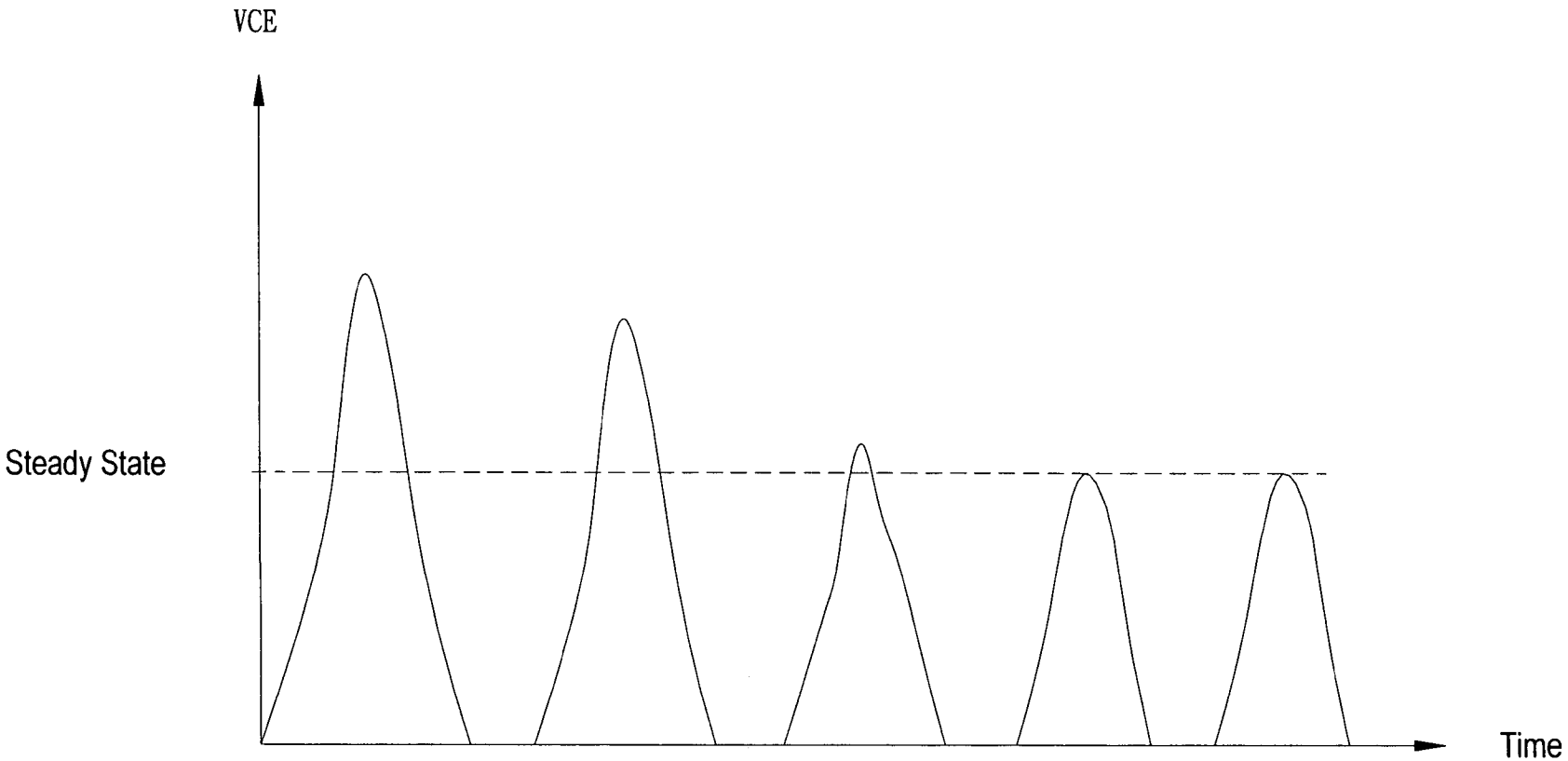
Fig. 1(b) PRIOR ART
Figure 2A:
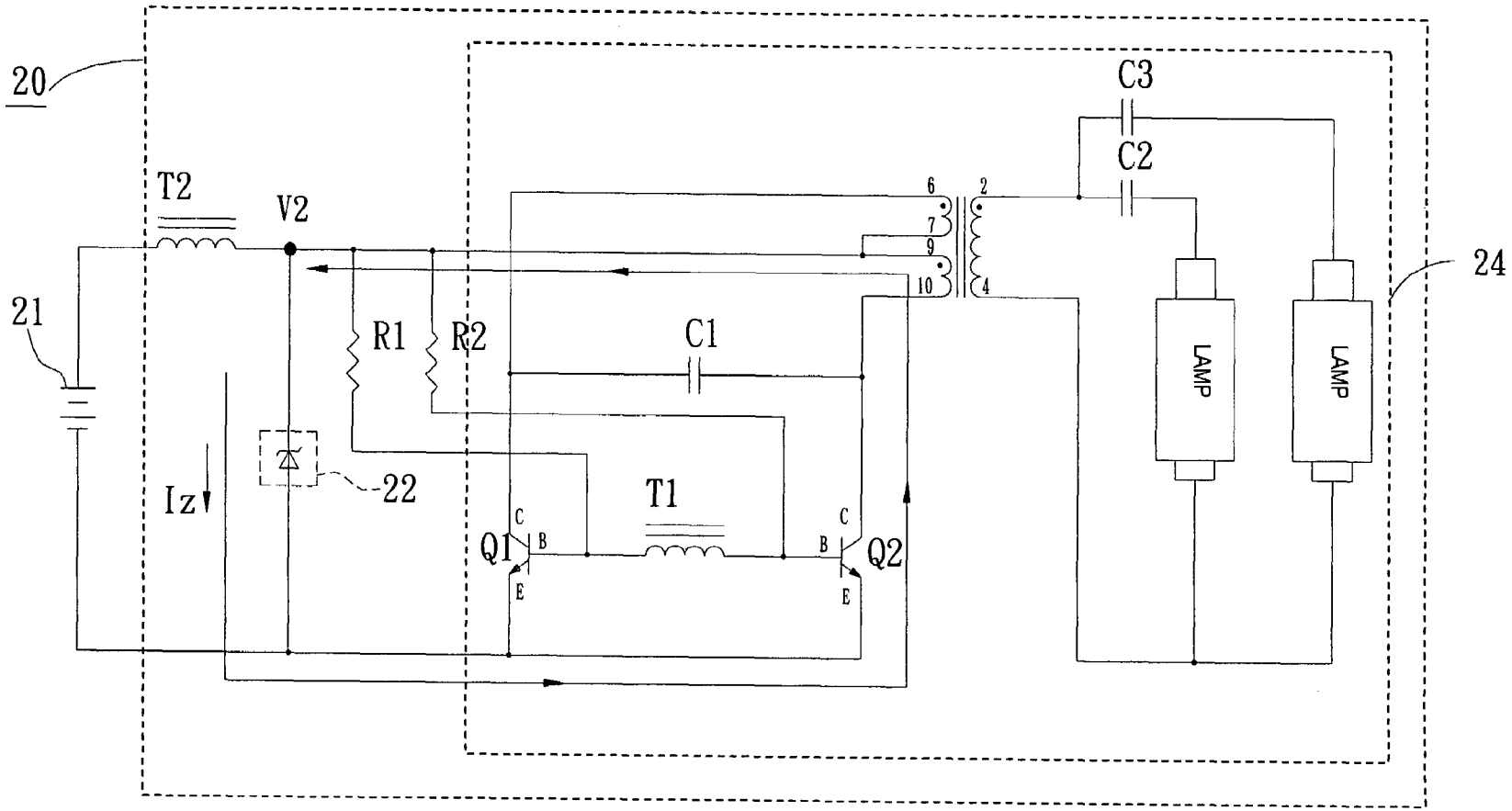
Fig. 2(a) PRIOR ART
FIG. 2(*a*) is a schematic circuit diagram of another conventional electronic ballast.
Figure 2B:
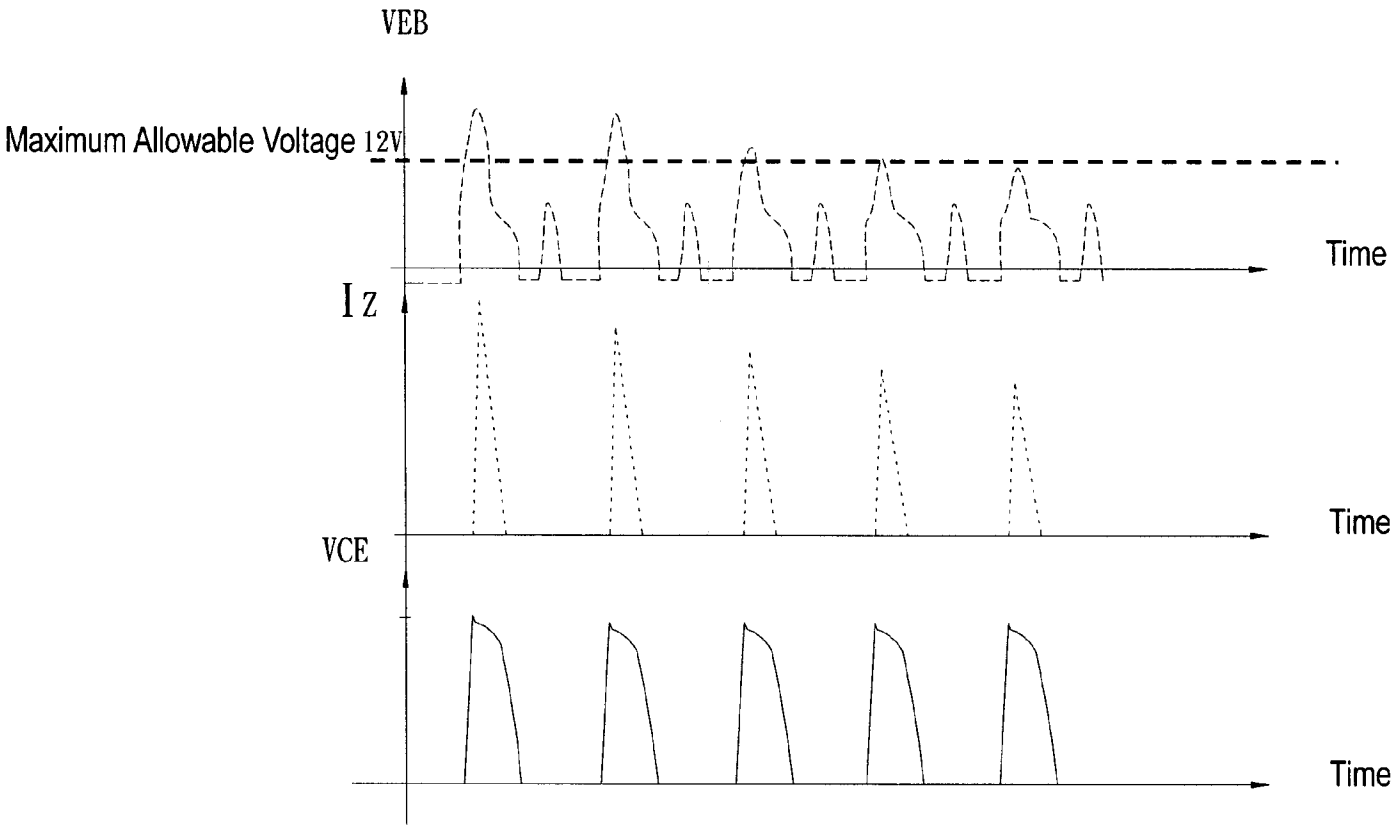
Fig. 2(b) PRIOR ART
Figure 3A:
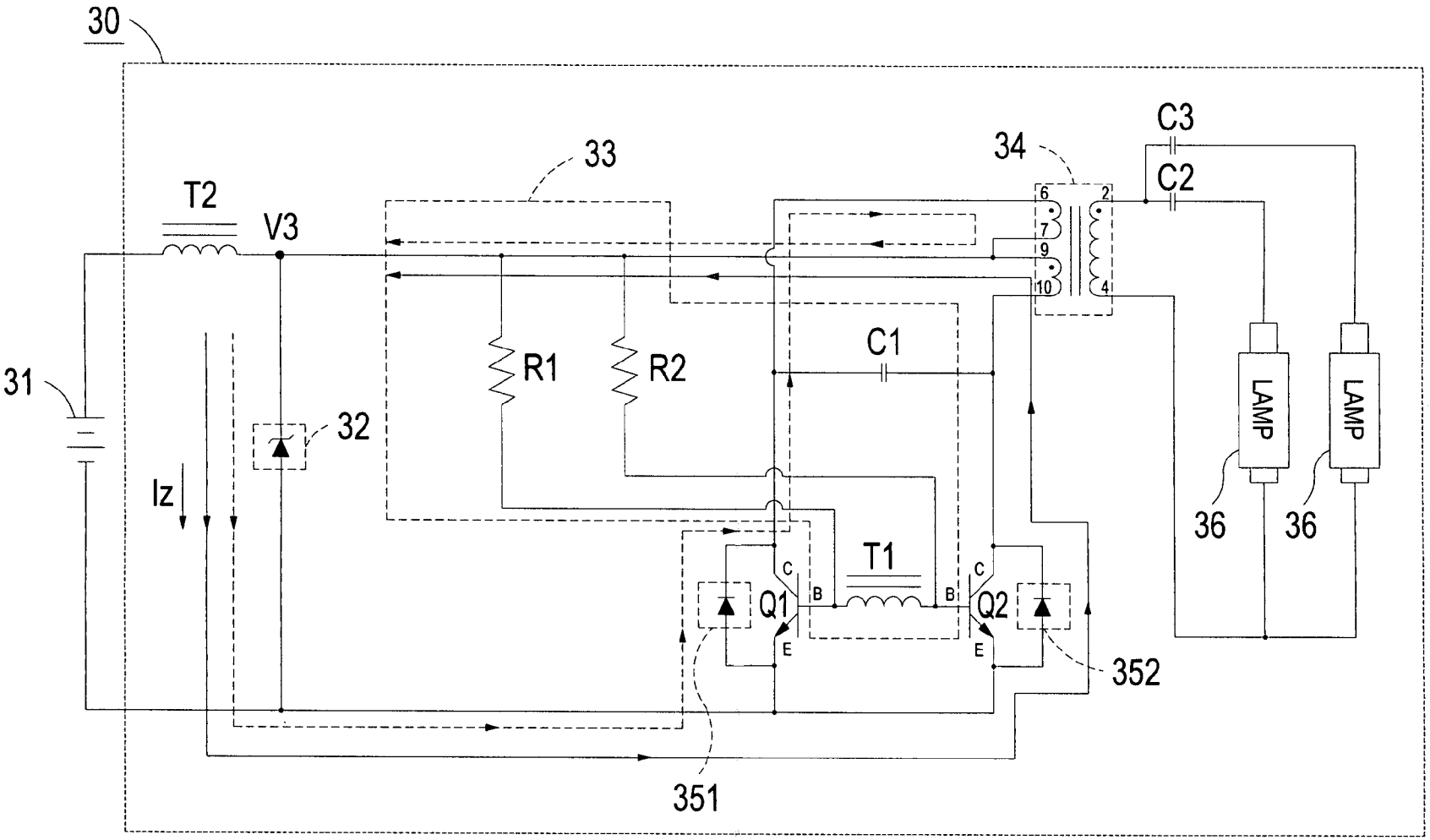
FIG. 3(*a*) is a schematic circuit diagram of an electronic ballast according to a preferred embodiment of the present invention.
Figure 3B:
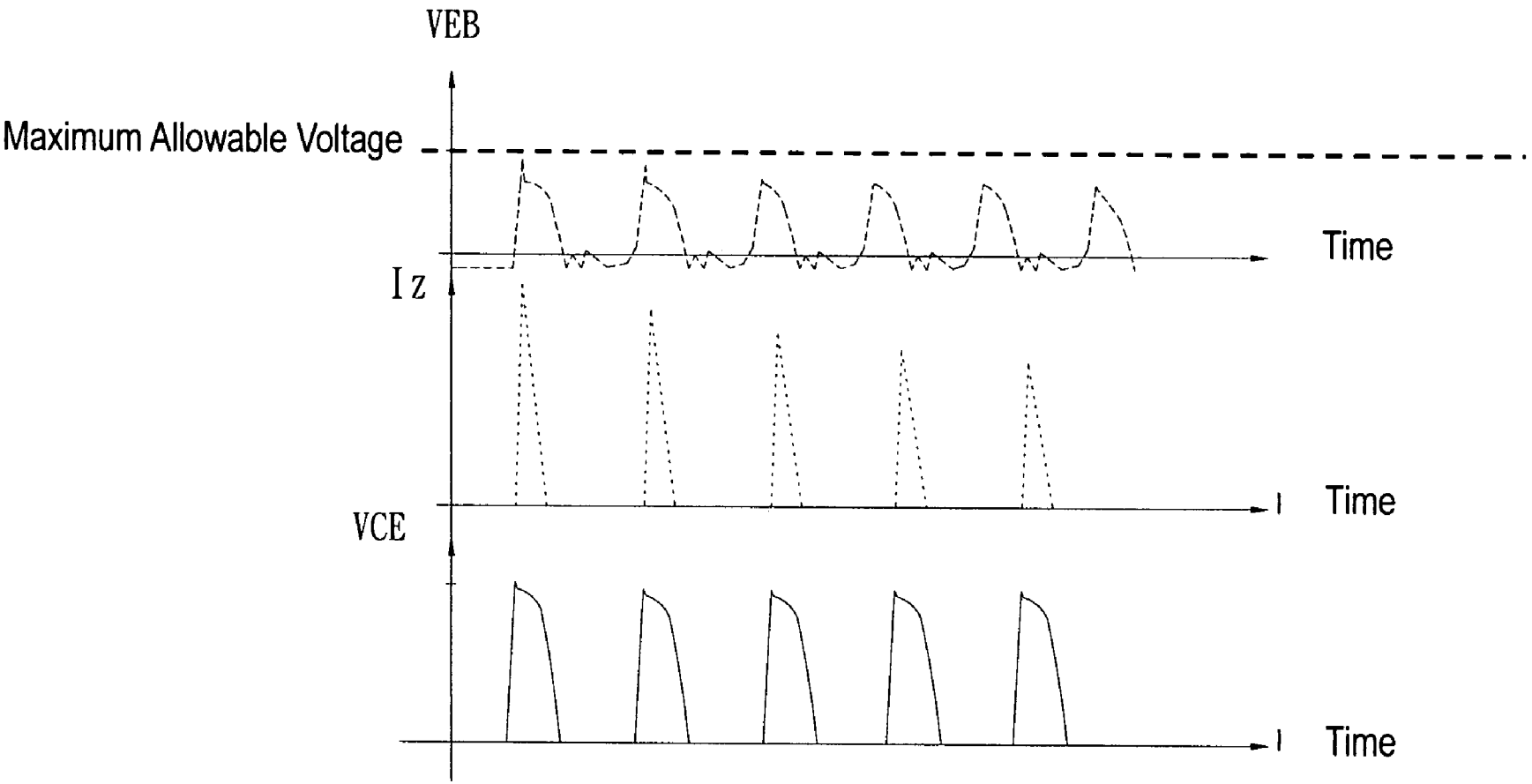

Referring to FIG. 3(*a*), a schematic circuit diagram of an electronic ballast according to a preferred embodiment of the present invention is shown. The electronic ballast 30 is powered by a DC power supply 31 and comprises an inductor T2, a clamping circuit 32, a control circuit 33, an output transformer 34, at least two switching elements Q1 and Q2, and at least two return circuits 351 and 352.

The inductor T2 is electrically connected to the DC power supply 31. The control circuit 33 is electrically connected to the inductor T2, the switching elements Q1 and Q2, the clamping circuit 32 and the output transformer 34 so as to control the turning on/off statuses of the switching elements Q1 and Q2. The control circuit 33 comprises resistors R1 and R2, a winding T1 of the output transformer 34, and a resonant capacitor C1. When the switching element Q1 is conducted, the switching element Q2 is shut. Whereas, when the switching element Q2 is conducted, the switching element Q1 is shut. By controlling the turning on/off statuses of the switching elements Q1 and Q2, there is voltage change in the primary winding of the output transformer 34, and the DC voltage provided by the DC power supply 31 is converted into a high-frequency AC voltage so as to activate several sets of fluorescent lamps 36.

In this embodiment, the output transformer 34 is a centre-tapped transformer. Some ballast capacitors (e.g. C2 and C3) are interconnected between the output transformer 34 and the fluorescent lamps 36 so as to adjust luminance of the respective fluorescent lamp 36. Each of the switching elements Q1 and Q2 is a NPN-type bipolar junction transistor having a base B, a collector C and an emitter E.

A linear relationship exists between the collector-to-emitter voltage (VCE) for the switching element Q1 or Q2 and the node voltage V3, which is the voltage across both terminals of the clamping circuit 32. If the node voltage V3 is larger than a preset limiting voltage at the moment when the electronic ballast 30 is started and the node voltage V3 has large transient voltage at the instant moment when the electronic ballast 30 is started, the transient voltage will be limited below the limiting voltage by the clamping circuit 32. Under this circumstance, the collector-to-emitter voltage (VCE) of the switching element Q1 or Q2 is reduced, and thus the switching element Q1 or Q2 is not readily damaged.

Since the clamping circuit 32 limits the node voltage V3 at the transient moment when the electronic ballast 30 is started, the reduced voltage is converted into the current Iz. In order to prevent that the reverse voltage between the base B and the emitter E of the switching element Q1 or Q2, i.e. VEB, exceeds the maximum allowable voltage when the current Iz flows through the emitter E and the collector C of the switching element Q1 or Q2, the return circuit 351 is connected to the collector C and the emitter E of the switching element Q1 and the return circuit 352 is connected to the collector C and the emitter E of the switching element Q2. In such manner, the current Iz outputted from the clamping circuit 32 may be transmitted to the output transformer 34 via the return circuit 351 or 352 without passing through the base B and emitter E of the switching element Q1 or Q2. Accordingly, the current Iz outputted from the clamping circuit 32 will no longer affect the reverse voltage of the switching element Q1 or Q2 because the reverse voltage is within the maximum allowable range.

In the above embodiments, the clamping circuit 32 used in the electronic ballast of the present invention can be a transient voltage suppressor, which is preferably implemented by a Zener diode. Each of the return circuit 351 and 352 is preferably a diode. It is noted that, however, those skilled in the art will readily observe that numerous modifications and alterations of the clamping circuit and the return circuit may be made while retaining the teachings of the invention. Accordingly, the above disclosure should be limited only by the bounds of the following claims.

For example, during the period from starting of the electronic ballast 30 to a stable state, when the switching element Q2 is conducted and the switching element Q1 is shut under control of the control circuit 33, the current Iz outputted from the clamping circuit 32 will be transmitted to the output transformer 34 via the return circuit 351, and afterwards return to the clamping circuit 32. Similarly, when the switching element Q1 is conducted and the switching element Q2 is shut under control of the control circuit 33, the current Iz outputted from the clamping circuit 32 will be transmitted to the output transformer 34 via the return circuit 352, and afterwards return to the clamping circuit 32. Since the current Iz outputted from the clamping circuit 32 will not pass through the base B and emitter E of the switching element Q1 or Q2 when the current Iz is transmitted to the output transformer 34, the reverse voltage between the base B and the emitter E of the switching element Q2, i.e. VEB, will lie in the range of the maximum allowable voltage.

FIG. 3(*b*) is a timing waveform diagram illustrating the current Iz from the clamping circuit, the emitter-to-base voltage (VEB) and the collector-to-emitter voltage (VCE) of the switching element Q1 or Q2. Each of the switching elements Q1 and Q2 is a BUL1102E transistor commercial available from ST Microelectronics. Since the return circuit 351 is connected to the collector C and the emitter E of the switching element Q1 and the return circuit 352 is connected to the collector C and the emitter E of the switching element Q2 according to the present invention, the reverse voltage between the base B and the emitter E of the switching element Q1 or Q2 (i.e. VEB) is within the maximum allowable range.

In the above embodiment, BUJ403A transistors from Koninklijke Philips Electronics N.V. may also be selected as the switching elements Q1 and Q2. In addition, each of the return circuit 351 and 352 is preferably a BA159 diode commercial available from Vishay Intertechnology, Inc. Alternatively, chips having similar functions can be used as the return circuit 351 and 352.

Figure 4:
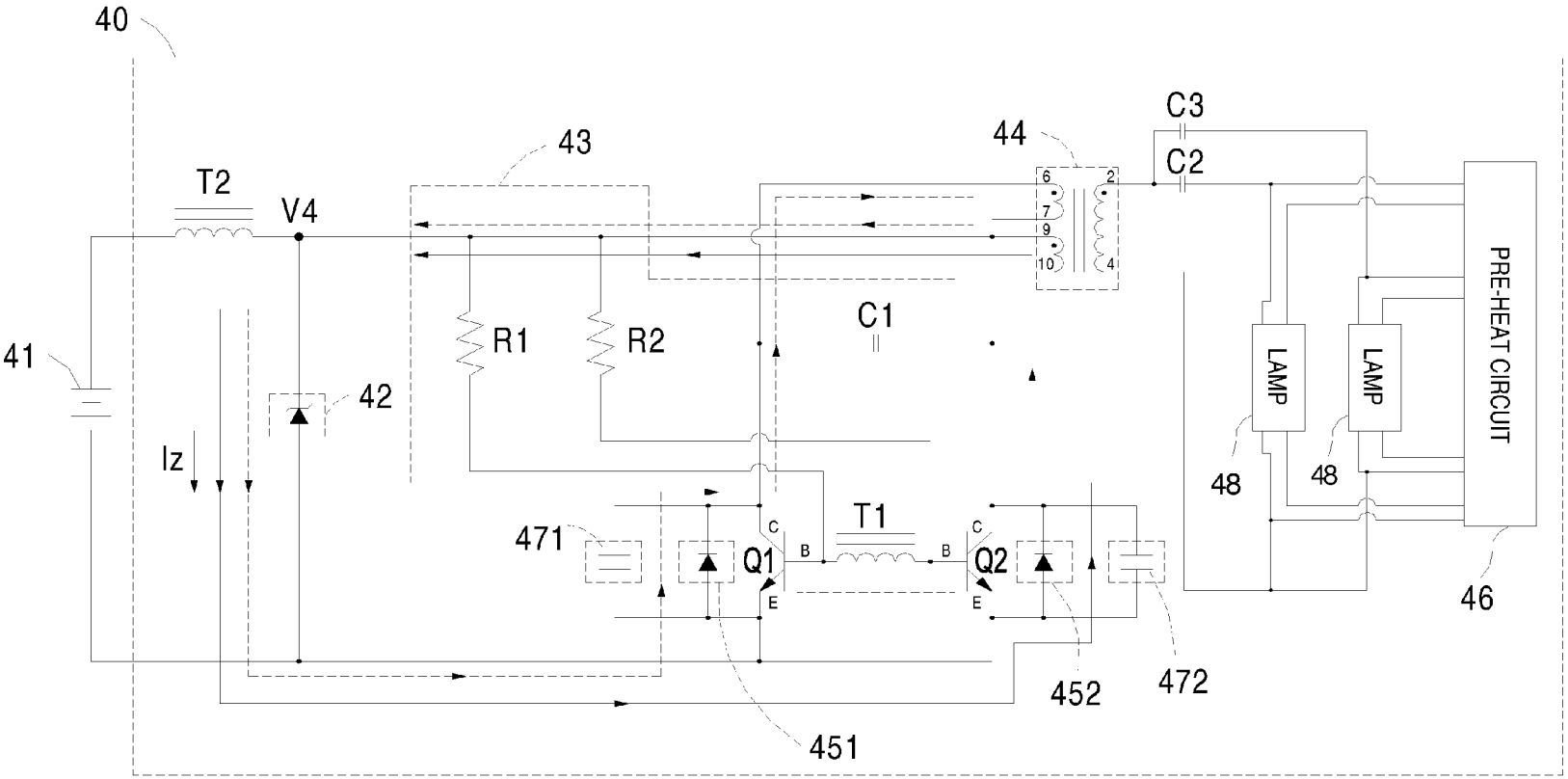
FIG. 4 is a schematic circuit diagram of an electronic ballast according to another preferred embodiment of the present invention.

Referring to FIG. 4, a schematic circuit diagram of a preheat type electronic ballast according to another preferred embodiment of the present invention is shown. The electronic ballast 40 is powered by a DC power supply 41 and comprises an inductor T2, a clamping circuit 42, a control circuit 43, an output transformer 44, at least two switching elements Q1 and Q2, at least two return circuits 451 and 452, a preheat circuit 46 and at least two capacitors 471, 472.

The inductor T2 is electrically connected to the DC power supply 41. The control circuit 43 is electrically connected to the inductor T2, the switching elements Q1 and Q2, the clamping circuit 42 and the output transformer 44 so as to control the turning on/off statuses of the switching elements Q1 and Q2. The control circuit 43 comprises resistors R1 and R2, a winding T1 of the output transformer 44 and a resonant capacitor C1. When the switching element Q1 is conducted, the switching element Q2 is shut. Whereas, when the switching element Q2 is conducted, the switching element Q1 is shut. By controlling the turning on/off statuses of the switching elements Q1 and Q2, there is voltage change in the primary winding of the output transformer 44, and the DC voltage provided by the DC power supply 41 is converted into a high-frequency AC voltage so as to activate several sets of fluorescent lamps 48.

In this embodiment, the output transformer 44 is a centre-tapped transformer. Some ballast capacitors (e.g. C2 and C3) are interconnected between the output transformer 44 and the fluorescent lamps 48 so as to adjust luminance of the respective fluorescent lamp 48. Each of the switching elements Q1 and Q2 is a NPN-type bipolar junction transistor having a base B, a collector C and an emitter E.

A linear relationship exists between the collector-to-emitter voltage (VCE) for the switching element Q1 or Q2 and the node voltage V4, which is the voltage across both terminals of the clamping circuit 42. If the node voltage V4 is larger than a preset limiting voltage at the moment when the electronic ballast 40 is started and the node voltage V4 has large transient voltage at the instant moment when the electronic ballast 40 is started, the transient voltage will be limited below the limiting voltage by the clamping circuit 42. Under this circumstance, the collector-to-emitter voltage (VCE) of the switching element Q1 or Q2 is reduced, and thus the switching element Q1 or Q2 is not readily damaged.

Since the clamping circuit 42 limits the node voltage V4 at the transient moment when the electronic ballast 40 is started, the reduced voltage is converted into the current Iz. In order to prevent the reverse voltage between the base B and the emitter E of the switching element Q1 or Q2, i.e. VEB, exceeds the maximum allowable voltage when the current Iz flows through the emitter E and the collector C of the switching element Q1 or Q2, the return circuit 451 is connected to the collector C and the emitter E of the switching element Q1 and the return circuit 452 is connected to the collector C and the emitter E of the switching element Q2. In such manner, the current Iz outputted from the clamping circuit 42 may be transmitted to the output transformer 44 via the return circuit 451 or 452 without passing through the base B and emitter E of the switching element Q1 or Q2. Accordingly, the current Iz outputted from the clamping circuit 42 will no longer affect the reverse voltage of the switching element Q1 or Q2 because the reverse voltage is within the maximum allowable range.

In the above embodiments, the clamping circuit 42 used in the electronic ballast of the present invention can be a transient voltage suppressor, which is preferably implemented by a Zener diode. Each of the return circuits 451 and 452 is preferably a diode. It is noted that, however, those skilled in the art will readily observe that numerous modifications and alterations of the clamping circuit and the return circuit may be made while retaining the teachings of the invention. Accordingly, the above disclosure should be limited only by the bounds of the following claims.

For example, during the period from starting of the electronic ballast 40 to a stable state, when the switching element Q2 is conducted and the switching element Q1 is shut under control of the control circuit 43, the current Iz outputted from the clamping circuit 42 will be transmitted to the output transformer 44 via the return circuit 451, and afterwards return to the clamping circuit 42. Similarly, when the switching element Q1 is conducted and the switching element Q2 is shut under control of the control circuit 43, the current Iz outputted from the clamping circuit 42 will be transmitted to the output transformer 44 via the return circuit 452, and afterwards return to the clamping circuit 42. Since the current Iz outputted from the clamping circuit 42 will not pass through the base B and emitter E of the switching element Q1 or Q2 when the current Iz is transmitted to the output transformer 44, the reverse voltage between the base B and the emitter E of the switching element Q2, i.e. VEB, will lie in the range of the maximum allowable voltage.

In addition, the preheat circuit 46 is electrically connected to the ballast capacitors (e.g. C2 and C3) and the fluorescent lamps 48 for preheating the fluorescent lamps 48. When the electronic ballast 40 is started, the fluorescent lamps 48 are preheated by the preheat circuit 46. Due to the operation of the preheat circuit 46, the switching elements Q1 and Q2 may enter into over-saturation state, which will damage the switching elements Q1 and Q2 at the transient moment when the electronic ballast 40 is started. In order to prevent the switching elements Q1 and Q2 from entering into over-saturation state, two capacitors 471, 472 are respectively employed and coupled to the return circuits 451 and 452 and the collectors C and emitters E of the switching elements Q1 or Q2.

From the above description, since the current outputted from the clamping circuit will be directly transmitted to the output transformer without passing through the base and the collector of the switching element, the reverse voltage of the switching element of the electronic ballast is within the maximum allowable range. Accordingly, the yield, average life and performance of the electronic ballast are enhanced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An electronic ballast comprising:

an inductor electrically coupled to a DC power supply;

an output transformer;

at least two switching elements;

a control circuit having a resonant capacitor and electrically connected to said inductor, said output transformer and said at least two switching elements for controlling on/off statuses of said at least two switching elements;

a clamping circuit electrically connected to said inductor, and limiting a node voltage among said inductor, said control circuit and said clamping circuit below a threshold value and generating an output current on condition that said node voltage is larger than said threshold value; and at least two return circuits, each of which is electrically connected to said clamping circuit and coupled to both terminals of one of said at least two switching elements for transmitting said output current to pass said output transformer and return to said clamping circuit on condition that said node voltage is larger than said threshold value, thereby permitting a reverse voltage of said at least two switching elements within a maximum allowable range of said at least two switching elements.

2. The electronic ballast according to claim 1 wherein said output transformer is a centre-tapped transformer.

3. The electronic ballast according to claim 1 wherein said clamping circuit is a transient voltage suppressor for limiting said node voltage below said threshold value and generating said output current on condition that said node voltage is larger than said threshold value.

4. The electronic ballast according to claim 3 wherein said transient voltage suppressor is a Zener diode.

5. The electronic ballast according to claim 1 wherein each of said at least two switching elements is a NPN-type bipolar junction transistor having a base, a collector and an emitter.

6. The electronic ballast according to claim 5 wherein each of said at least two return circuits is coupled to said collector and said emitter of one of said at least two switching elements.

7. The electronic ballast according to claim 6 wherein said at least two return circuits are diodes.

8. The electronic ballast according to claim 6 wherein said control circuit comprises two resistors and a winding of said output transformer.

9. The electronic ballast according to claim 1 further comprising a plurality of ballast capacitors electrically connected between a secondary winding of said output transformer and at least two lamps.

10. The electronic ballast according to claim 9 further comprising a preheat circuit electrically connected to said plurality of ballast capacitors and said at least two lamps for preheating said at least two lamps.

11. The electronic ballast according to claim 10 further comprising at least two capacitors, each of which is electrically connected to one of said at least two return circuits and a collector terminal and an emitter terminal of one of said at least two switch elements.

* * * * *